US008807682B2

(12) United States Patent
Hagiwara et al.

(10) Patent No.: US 8,807,682 B2
(45) Date of Patent: Aug. 19, 2014

(54) LIQUID EJECTING APPARATUS WITH A HEAD SECURING MEMBER AND A LINEAR SCALE, WHOSE MATERIALS ARE SELECTED FOR SPECIFIC THERMAL EXPANSION CHARACTERISTICS

(75) Inventors: Hiroyuki Hagiwara, Matsumoto (JP); Tomohiro Yuda, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 13/347,583

(22) Filed: Jan. 10, 2012

(65) Prior Publication Data

US 2012/0176432 A1 Jul. 12, 2012

(30) Foreign Application Priority Data

Jan. 11, 2011 (JP) ..... 2011-003227

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS

| | | | | |
|---|---|---|---|---|
| 6,457,797 | B1 * | 10/2002 | Van Der Meijs et al. | 347/14 |
| 2003/0016266 | A1 | 1/2003 | Urselmann | |
| 2007/0024659 | A1 * | 2/2007 | Grosse et al. | 347/19 |
| 2010/0231640 | A1 * | 9/2010 | Tsuzuki | 347/30 |

FOREIGN PATENT DOCUMENTS

| | | | |
|---|---|---|---|
| JP | 2000-355110 | A | 12/2000 |
| JP | 2003-054062 | A | 2/2003 |
| JP | 2010-214608 | A | 9/2010 |

* cited by examiner

*Primary Examiner* — Geoffrey Mruk
*Assistant Examiner* — Bradley Thies
(74) *Attorney, Agent, or Firm* — Kilpatrick Townsend & Stockton LLP

(57) ABSTRACT

When it is assumed that an expected maximum temperature change from a reference temperature during usage of a printer is Δt, an ink landing interval corresponding to raster resolution on a recording medium in a head main scanning direction is P, a maximum distance between nozzle rows of recording heads on a sub carriage is L, a linear expansion coefficient of a linear scale is α2, and a linear expansion coefficient of the sub carriage is α1, $L(|\alpha 1-\alpha 2|)\Delta t \leq P/2$ is satisfied.

20 Claims, 11 Drawing Sheets

| COMBINATION EXAMPLE | SUB CARRIAGE | | LINEAR SCALE | | (3) L | (4) Δt | P | (5) P/2 | (6) (α1−α2)*Δt*L | JUDGMENT |
|---|---|---|---|---|---|---|---|---|---|---|
| | MATERIAL | (1) α1 LINEAR EXPANSION COEFFICIENT | MATERIAL | (2) α2 LINEAR EXPANSION COEFFICIENT | DISTANCE BETWEEN NOZZLE ROWS mm | TEMPERATURE CHANGE Δt[°C] | RASTER RESOLUTION | RASTER RESOLUTION 1/2 | DEVIATION AMOUNT μm | (6) ≤ (5) |
| 1 | MATERIAL: MODIFIED POLYPHENYLENE ETHER (PPE) RESIN REGISTERED TRADEMARK, PRODUCT NAME: ZYLON (ASAHI KASEI CHEMICALS CORPORATION) | 5.0E−05 | POLYESTER | 6.0E−05 | 65 | 15 | 720 dpi =35.2 μm | 17.6 | 9.8 | ○ |
| 2 | ALUMINUM ALLOY ADC12 | 2.1E−05 | SUS304 | 1.7E−05 | 65 | 15 | 720 dpi =35.2 μm | 17.6 | 3.6 | ○ |
| 3 | STAINLESS STEEL SUS304 | 1.7E−05 | SUS304 | 1.7E−05 | 65 | 15 | 720 dpi =35.2 μm | 17.6 | 0.0 | ○ |
| 4 | STAINLESS STEEL SUS430 | 1.0E−05 | GLASS | 8.0E−06 | 65 | 15 | 720 dpi =35.2 μm | 17.6 | 2.3 | ○ |

FIG. 14

| COMBINATION EXAMPLE | SUB CARRIAGE | | LINEAR SCALE | | (3) L | (4) Δt | P | (5) P/2 | (6) (α1−α2)*Δt*L | JUDGMENT |
|---|---|---|---|---|---|---|---|---|---|---|
| | MATERIAL | (1) α1 LINEAR EXPANSION COEFFICIENT | MATERIAL | (2) α2 LINEAR EXPANSION COEFFICIENT | DISTANCE BETWEEN NOZZLE ROWS mm | TEMPERATURE CHANGE Δt [°C] | RASTER RESOLUTION | RASTER RESOLUTION 1/2 | DEVIATION AMOUNT μm | (6) ≤ (5) |
| 1 | MATERIAL: MODIFIED POLYPHENYLENE ETHER (PPE) RESIN REGISTERED TRADEMARK, PRODUCT NAME: ZYLON (ASAHI KASEI CHEMICALS CORPORATION) | 5.0E−05 | POLYESTER | 6.0E−05 | 65 | 15 | 720 dpi =35.2 μm | 17.6 | 9.8 | ○ |
| 2 | ALUMINUM ALLOY ADC12 | 2.1E−05 | SUS304 | 1.7E−05 | 65 | 15 | 720 dpi =35.2 μm | 17.6 | 3.6 | ○ |
| 3 | STAINLESS STEEL SUS304 | 1.7E−05 | SUS304 | 1.7E−05 | 65 | 15 | 720 dpi =35.2 μm | 17.6 | 0.0 | ○ |
| 4 | STAINLESS STEEL SUS430 | 1.0E−05 | GLASS | 8.0E−06 | 65 | 15 | 720 dpi =35.2 μm | 17.6 | 2.3 | ○ |

LIQUID EJECTING APPARATUS WITH A HEAD SECURING MEMBER AND A LINEAR SCALE, WHOSE MATERIALS ARE SELECTED FOR SPECIFIC THERMAL EXPANSION CHARACTERISTICS

The entire disclosure of Japanese Patent Application No: 2011-003227, filed Jan. 11, 2011 is expressly incorporated by reference herein.

BACKGROUND

1. Technical Field

The present invention relates to a liquid ejecting apparatus such as an ink jet recording apparatus, in particular, relates to a liquid ejecting apparatus including a linear encoder used for recognizing a scanning position of a liquid ejecting head unit.

2. Related Art

A liquid ejecting apparatus includes a liquid ejecting head which can eject liquid in form of liquid droplets and ejects various liquids from the liquid ejecting head. As a representative example of the liquid ejecting apparatus, an image recording apparatus such as an ink jet recording apparatus (printer) which includes an ink jet recording head (hereinafter, referred to as recording head) and ejects ink in a liquid state in form of ink droplets through nozzles of the recording head to perform recording can be exemplified. In recent years, the liquid ejecting apparatus is not limited to the image recording apparatus and is applied to various manufacturing apparatuses such as a display manufacturing apparatus. Further, the above image recording apparatus ejects ink in a liquid state from the recording head and the display manufacturing apparatus ejects solutions of color materials of Red (R), Green (G), and Blue (B) from a color material ejecting head. Further, an electrode manufacturing apparatus ejects an electrode material in a liquid state from an electrode material ejecting head. A chip manufacturing apparatus ejects a solution of a bioorganic material from a bioorganic ejecting head.

There is a liquid ejecting apparatus which ejects liquid onto a landing target such as recording paper while moving (scanning) a liquid ejecting head. In such liquid ejecting apparatus, liquid droplets need to be landed onto the landing target (corresponding to recording paper in a printer, for example) with high accuracy. Therefore, a linear encoder which recognizes a scanning position of the liquid ejecting head is provided in the liquid ejecting apparatus. The linear encoder is constituted by a linear scale having scales marked at a constant interval in a lengthwise direction and a detector which reads the scale on the linear scale. Various detection systems such as a magnetic system and an optical system are employed for the linear encoder. Further, the linear scale is arranged over a scanning range of the liquid ejecting head in the liquid ejecting apparatus. For example, in a printer as one type of the liquid ejecting apparatus, an encoder pulse is generated from the detector of the above linear encoder with movement of the recording head and a timing signal PTS (print timing signal) is generated from the encoder pulse. Then, transfer of print data, generation of a driving signal, ejection of ink from the recording head, and the like are controlled in synchronization with the encoder PTS signal (for example, see, JP-A-2010-214608). If such control is performed, an actual position of the liquid ejecting head and a control position of the ejecting head can be made identical to each other with high accuracy, thereby enhancing accuracy of the landing position of liquid droplets.

There is a printer having the following configuration as an example of the above printer. That is, a plurality of recording heads which have nozzle rows on which a plurality of nozzles are arranged in rows and are arranged in a scanning direction and secured to a head securing member such as a sub carriage are configured as one head unit. In the printer employing such configuration, when materials of the above linear scale and head securing member are different from each other, linear expansion coefficients of them are also different from each other. Therefore, landing positions of liquid droplets on a recording medium are deviated between the recording heads secured to the head securing member in some case. The landing positions of liquid droplets are deviated because of difference between a change amount of a distance between nozzle rows on the recording heads and a deformation amount of the linear scale when a sub carriage is deformed due to change of an environmental temperature. As a result, there has arisen a risk that image quality of a recorded image or the like is deteriorated. In particular, as the number of liquid ejecting heads secured to the head securing member is larger and the head unit is longer in the main scanning direction, influence by the deviation of the landing positions based on the difference of the linear expansion coefficients tends to be larger. In order to prevent the above problem from occurring, it can be considered that the linear scale and the head securing member are formed with the same material. However, in such a case, freedom of selection of materials is restricted.

It is to be noted that the above problem occurs not only in the ink jet recording apparatus on which recording heads for ejecting ink are mounted but also in other liquid ejecting apparatuses. To be more specific, the above problem also occurs in other liquid ejecting apparatuses having a configuration in which a plurality of liquid ejecting heads are secured to a head securing member to form a liquid ejecting head unit and a position of the liquid ejecting head unit in a scanning direction is detected by a linear encoder.

SUMMARY

An advantage of some aspects of the invention is to provide a liquid ejecting apparatus which can ensure liquid landing accuracy on a landing target even when an environmental temperature is changed.

A liquid ejecting apparatus according to an aspect of the invention includes: a liquid ejecting head unit which has a plurality of liquid ejecting heads having nozzles through which liquid is ejected, and a head securing member to which the plurality of liquid ejecting heads are secured in parallel in a first direction; a head unit movement mechanism which moves the liquid ejecting head unit in the first direction; and a linear encoder which has a linear scale arranged along the first direction and a detector for reading a scale formed on the linear scale, the liquid ejecting apparatus controlling liquid ejection of each liquid ejecting head based on a detection signal from the linear encoder. In the liquid ejecting apparatus, when it is assumed that an expected maximum temperature change from a reference temperature during usage of the liquid ejecting apparatus is $\Delta t$, a liquid landing interval corresponding to dot formation resolution on a landing target in the first direction is P, a maximum distance between nozzle rows of the liquid ejecting heads on the head securing member is L, a linear expansion coefficient of the head securing member is $\alpha 1$, and a linear expansion coefficient of the linear scale is $\alpha 2$, $L(|\alpha 1-\alpha 2|)\Delta t \leq P/2$ is satisfied.

According to the aspect of the invention, if materials of the head securing member and the linear scale are selected so as to satisfy $L(|\alpha 1-\alpha 2|)\Delta t \leq P/2$, even when an environmental temperature at which the liquid ejecting apparatus is used is changed, deviation of relative landing positions of liquid on the landing target between different liquid ejecting heads attached to the head securing member can be suppressed within an acceptable range. As a result, influence on image quality of an image recorded on a recording medium as the landing target can be suppressed. Further, the materials of the head securing member and the linear scale may not be necessarily the same so that freedom of selection of the materials can be ensured.

BRIEF DESCRIPTION OF THE DRAWINGS

The invention will be described with reference to the accompanying drawings, wherein like numbers reference like elements.

FIG. 14 is a table illustrating specific examples of combinations of materials of a sub carriage and the linear scale.

DESCRIPTION OF EXEMPLARY EMBODIMENTS

Hereinafter, an embodiment for carrying out the invention is described with reference to accompanying drawings. In the embodiment which will be described below, various limitations are made as a preferable specific example of the invention. However, a range of the invention is not limited to these aspects as long as description for limiting the invention is not given explicitly in the following explanation. Further, an ink jet recording apparatus (hereinafter, referred to as printer) is described as an example of a liquid ejecting apparatus according to the invention below.

Figure 1:
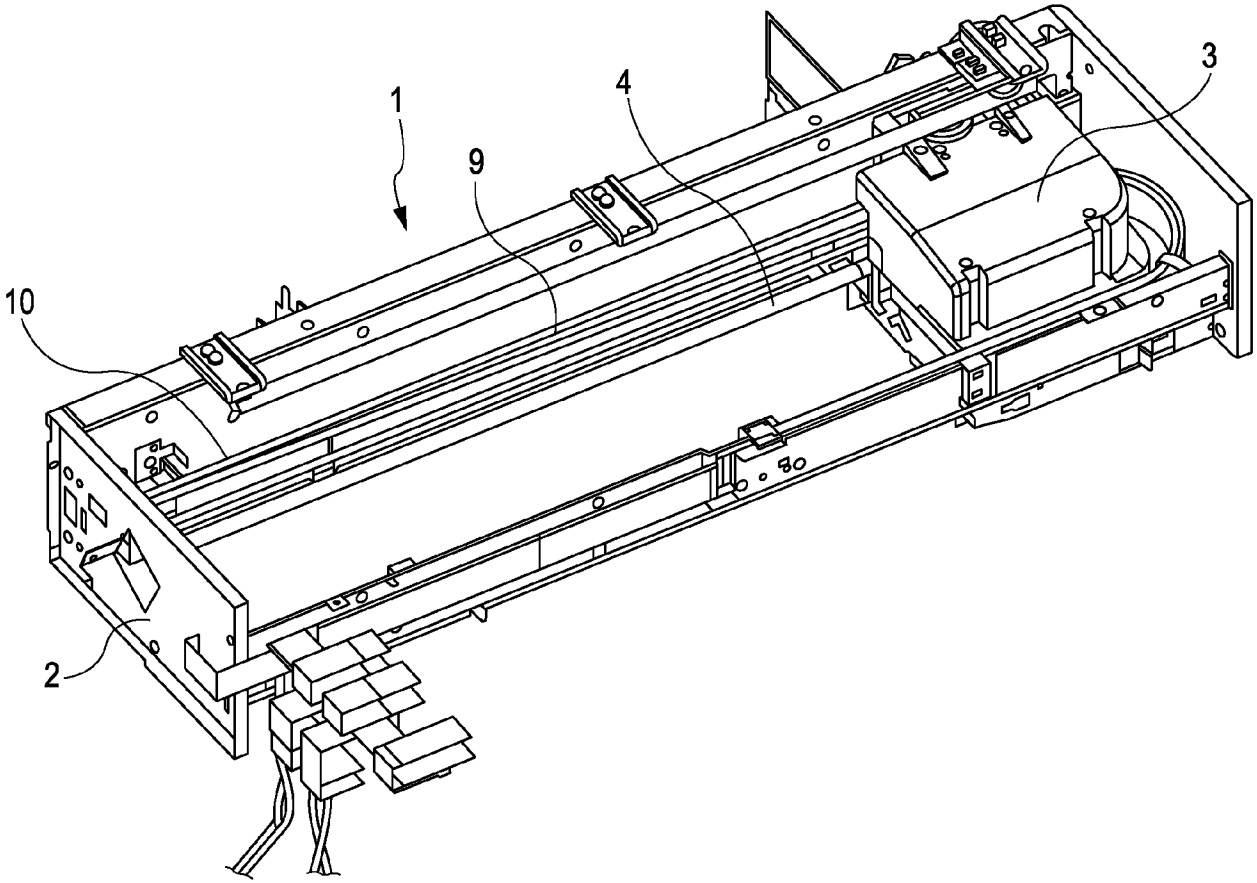
FIG. 1 is a perspective view illustrating a part of an inner configuration of a printer.
Figure 2:
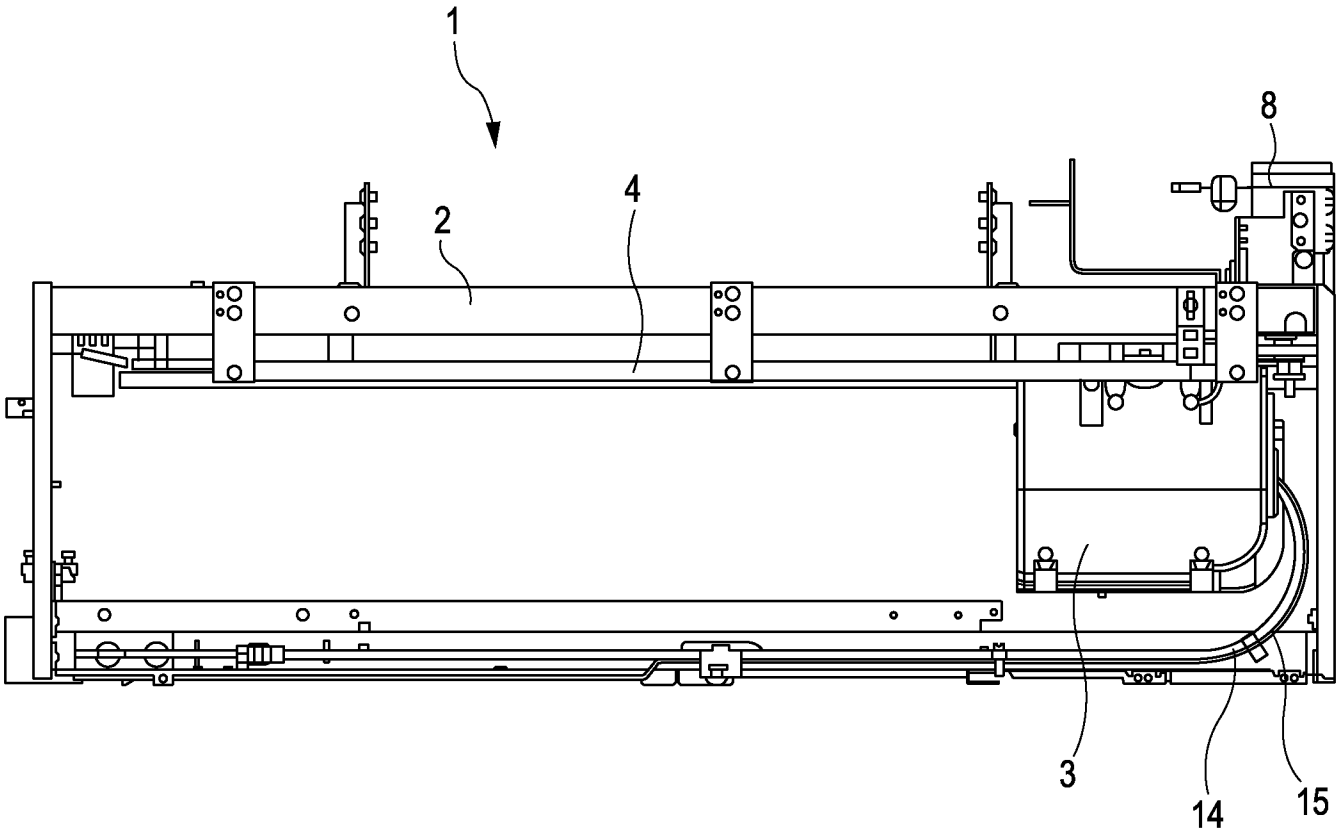
FIG. 2 is a plan view illustrating a part of the inner configuration of the printer.

FIG. 1 is a perspective view illustrating a part of an inner configuration of a printer 1. FIG. 2 is a plan view illustrating the printer 1. The printer 1 as illustrated in FIG. 1 and FIG. 2 ejects ink as one type of liquid onto a recording medium (landing target) such as recording paper, a fabric, and a film. A carriage assembly 3 (hereinafter, also referred to as carriage 3) is mounted in a frame 2 on the printer 1 so as to reciprocate in a main scanning direction (corresponding to a first direction in the invention) intersecting with a feeding direction of the recording medium. A long guide rod 4 is attached to an inner wall of the frame 2 at the rear face side of the printer 1 so as to follow along the main scanning direction. The guide rod 4 is fitted into a bearing portion 7 (see, FIG. 6) provided at the rear face side of the carriage 3 so that the carriage 3 is supported on the guide rod 4 in a slidable manner.

A carriage motor 8 as a driving source for moving the carriage 3 is arranged at the rear face side of the frame 2 at one end side (right end in FIG. 2) in the main scanning direction. A driving shaft of the carriage motor 8 projects to the inner face side from the rear face side of the frame 2 and a driving pulley (not illustrated) is connected to a front end thereof. The driving pulley is rotated by driving the carriage motor 8. Further, an idling pulley (not illustrated) is provided at a position which is on the opposite side (left end in FIG. 2) to the driving pulley in the main scanning direction. A timing belt 9 (see, FIG. 1) is stretched over these pulleys. The carriage 3 is connected to the timing belt 9. Further, if the carriage motor 8 is driven, the timing belt 9 is rotationally moved with the rotation of the driving pulley and the carriage 3 is moved along the guide rod 4 in the main scanning direction. That is to say, the carriage motor 8, the driving pulley, the idling pulley, and the timing belt 9 constitute a carriage movement mechanism 6 (corresponding to the head unit movement mechanism in the invention). In addition, the printer 1 includes a transportation mechanism 23 (see, FIG. 12) which transports recording paper fed from a paper feeding tray (not illustrated) in a sub scanning direction which is perpendicular to the main scanning direction.

Figure 3:
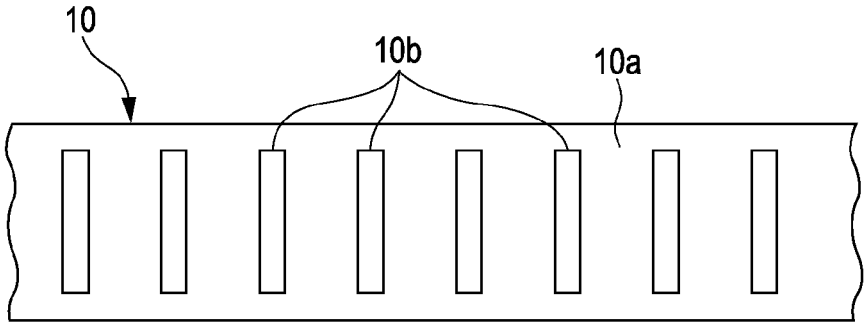
FIG. 3 is a partial enlarged view illustrating a linear scale.
Figure 6:
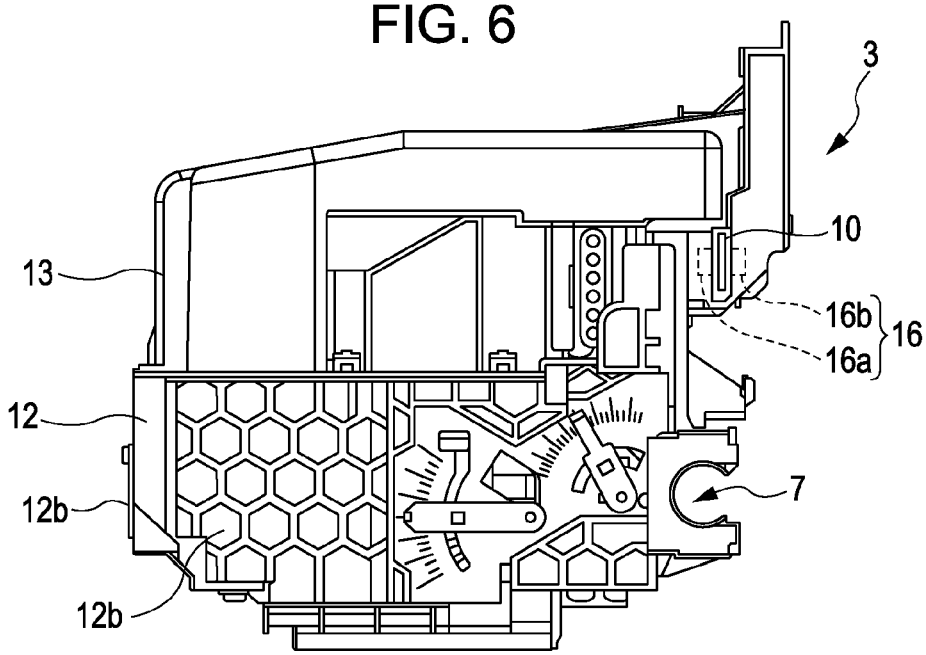
FIG. 6 is a side view illustrating the carriage.

In the printer 1, a scanning position of a head unit 17 (one type of a liquid ejecting head unit in the invention) mounted on the carriage 3 is detected by a linear encoder 11. The linear encoder 11 includes a linear scale 10 and a detector 16 (FIG. 6). The linear scale 10 is provided on an inner wall of the rear face of the frame 2 in a tension manner along the main scanning direction. The detector 16 is attached to the rear face of the carriage 3. As a detection system of the linear encoder 11, an optical system, a magnetic system, and the like are cited. In the printer 1 according to the embodiment, the optical system linear encoder 11 is employed. As illustrated in FIG. 3, the linear scale 10 is a belt-like member. Further, in the embodiment, a plurality of longitudinal slits 10*b* (slits elongated in a belt width direction) are formed along a lengthwise direction of a base material 10*a*. The base material 10*a* has a transmittance which is sufficiently smaller than that of the slits 10*b*, or light is not transmitted through the base material 10*a*. The slits 10*b* are formed at a constant pitch in the lengthwise direction of the base material 10*a*, for example, at a pitch corresponding to 180 dpi. Further, the detector 16 is constituted by a pair of a light emitting element 16*a* and a light receiving element 16*b*, which are arranged to be opposed to each other. The above linear scale 10 is arranged so as to pass through between the light emitting element 16*a* and the light receiving element 16*b*. Further, the detector 16 outputs an encoder pulse in accordance with difference between a light reception state on the slits 10*b* of the linear scale 10 and a light reception state on portions other than the slits. It is to be noted that a relationship in magnitude of the light transmittance between the base material 10*a* and the slits 10*b* may be opposite to the above-described relationship therebetween.

The linear encoder 11 outputs an encoder pulse in accordance with a scanning position of the carriage 3 as positional information of the carriage 3 in the main scanning direction. With this, a printer controller 61 (see, FIG. 12), which will be described later, can control a recording operation by the recording heads 18 of the head unit 17 on a recording medium while recognizing the scanning position of the head unit 17 mounted on the carriage 3 based on the encoder pulse from the linear encoder 11. Further, the printer 1 is configured so as to perform a so-called bidirectional recording processing. The bidirectional recording processing is a process of recording characters, images, and the like on recording paper in both directions at an outbound movement time and an inbound movement time. At the outbound movement time, the carriage 3 moves from a home position at one end side to an end (full position) at the opposite side in the main scanning direction. At the inbound movement time, the carriage 3 returns from the full position to the home position side.

As illustrated in FIG. 2, an ink supply tube 14 and a signal cable 15 are connected to the carriage 3. The ink supply tube 14 supplies ink of each color to each recording head 18 of the head unit 17. The signal cable 15 supplies a signal such as a driving signal. In addition, although not illustrated in the drawings, a cartridge mounting portion, a transportation portion, a capping portion, and the like are provided on the printer 1. Ink cartridges (liquid supply source) in which inks are stored are detachably attached to the cartridge mounting portion. The transportation portion transports recording paper. The capping portion caps nozzle formation faces 53 (see, FIG. 11) of the recording heads 18 in a standby state.

Figure 4:
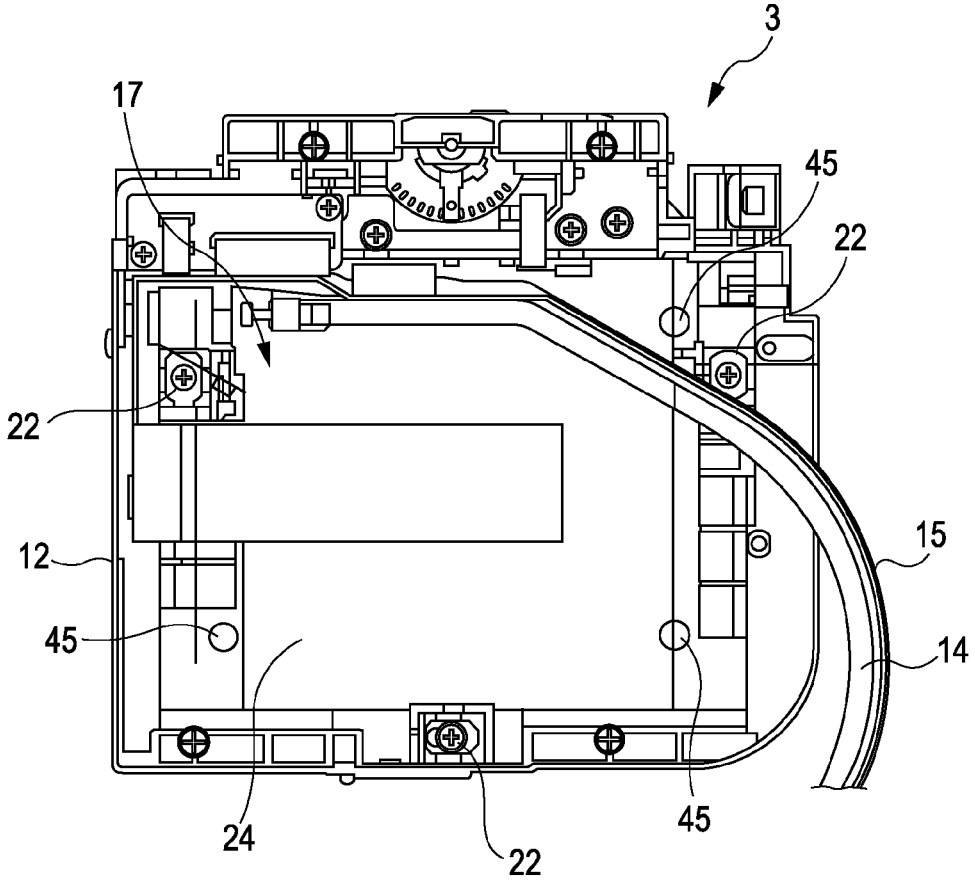
FIG. 4 is a top view illustrating a carriage.
Figure 5:
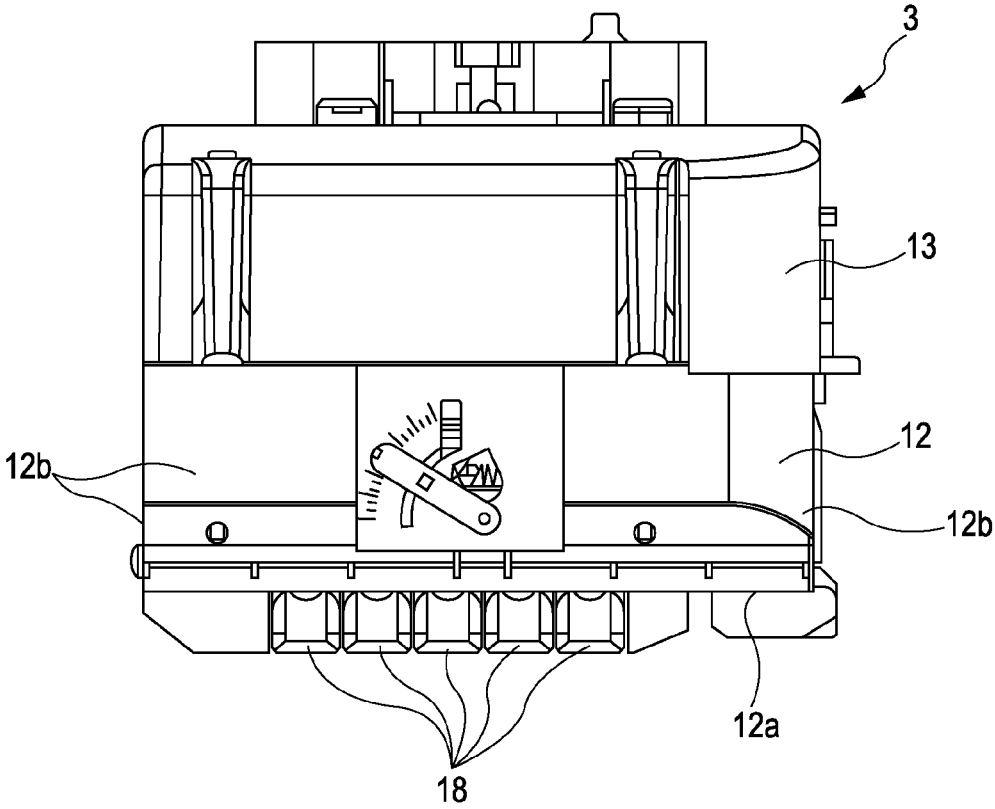
FIG. 5 is a front view illustrating the carriage.
Figure 7:
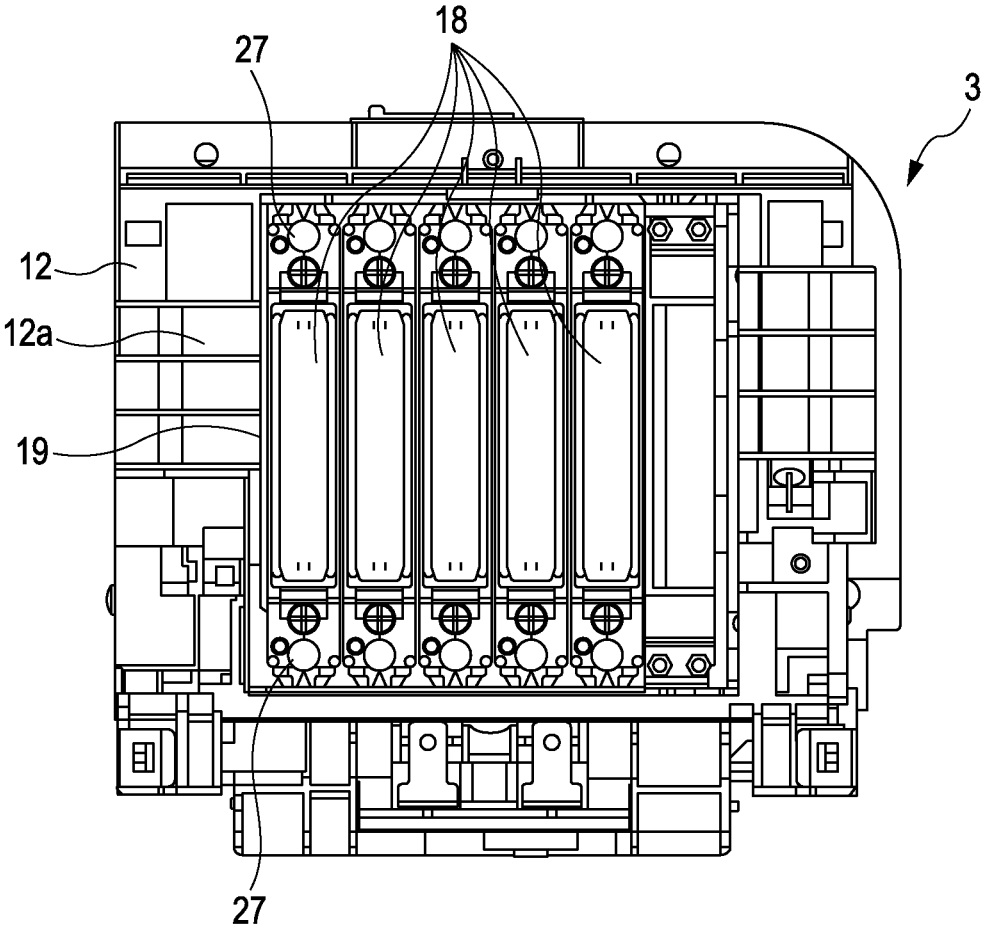
FIG. 7 is a bottom view illustrating the carriage.

FIG. 4 is a plan (top) view illustrating the carriage 3. FIG. 5 is a front view illustrating the carriage 3. FIG. 6 is a right side view illustrating the carriage 3. FIG. 7 is a bottom view illustrating the carriage 3. FIG. 4 illustrates a state where a carriage cover 13 is removed. The carriage 3 is constituted by a carriage main body 12 in which the head unit 17, which will be described later, is mounted, and the carriage cover 13 which closes an upper opening of the carriage main body 12. The carriage 3 is a member having a hollow box shape which can be divided into the upper side and the lower side. The carriage main body 12 is constituted by a bottom plate portion 12*a* and side wall portions 12*b*. The bottom plate portion 12*a* has a substantially rectangular shape. The side wall portions 12*b* are erected upward from four outer peripheral edges of the bottom plate portion 12*a*. The head unit 17 is accommodated in a space surrounded by the bottom plate portion 12*a* and the side wall portions 12*b*. A bottom opening 19 for exposing the nozzle formation faces 53 of the recording heads 18 of the accommodated head unit 17 is provided in the bottom plate portion 12*a*. Further, the nozzle formation faces 53 of the recording heads 18 project to the lower side (recording medium side at the time of recording operation) with respect to the bottom of the carriage main body 12 from the bottom opening 19 of the bottom plate portion 12*a* in a state where the head unit 17 is accommodated in the carriage main body 12.

Figure 8A:
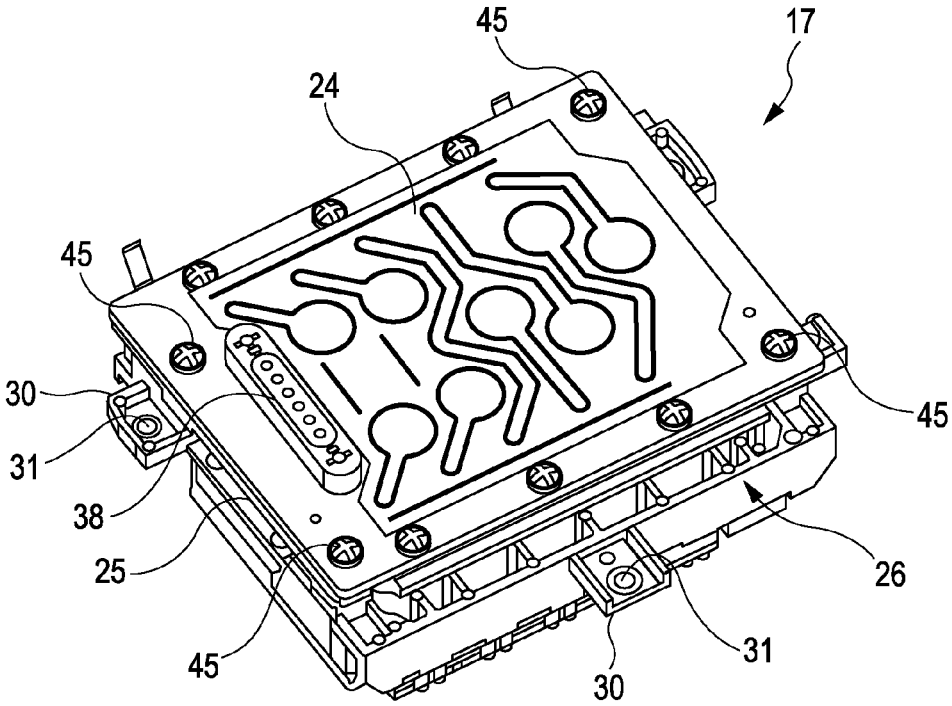
FIGS. 8A and 8B are perspective views illustrating a head unit.
Figure 8B:
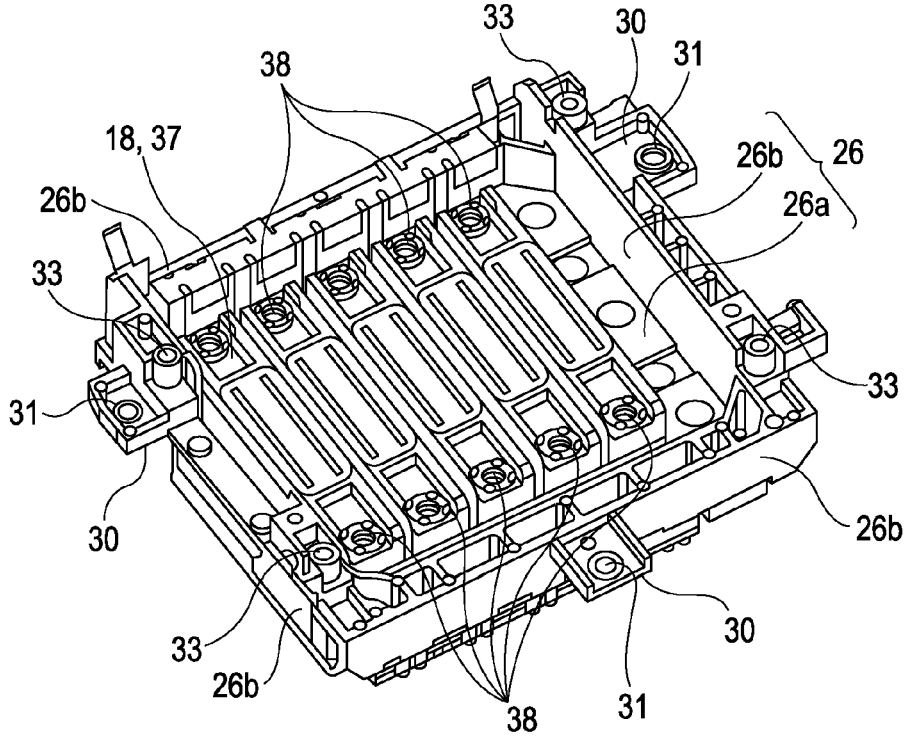
Figure 9:
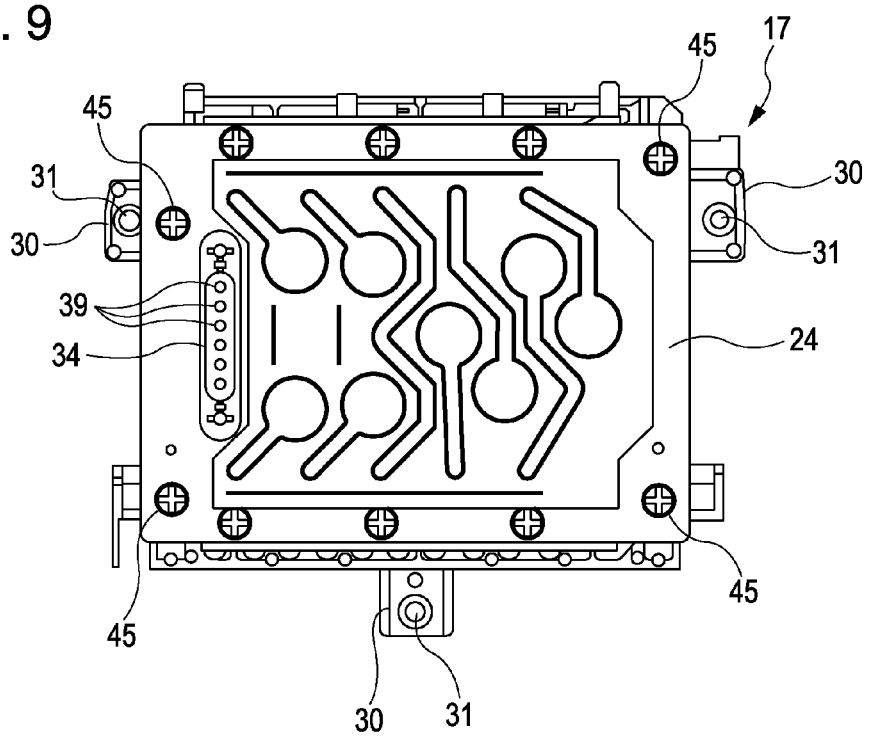
FIG. 9 is a top view illustrating the head unit.

FIGS. 8A and 8B are perspective views illustrating the head unit 17. FIG. 8A illustrates a state where a flow path member 24 is attached and FIG. 8B illustrates a state where the flow path member 24 is detached. Further, FIG. 9 is a top view illustrating the head unit 17 and FIG. 10 is a bottom view illustrating the head unit 17.

The head unit 17 is formed by unitizing the plurality of recording heads 18 and the like. The head unit 17 includes a sub carriage 26 (one type of a head securing member in the invention) to which these recording heads 18 are attached, and the flow path member 24. The sub carriage 26 is constituted by a plate-like base portion 26*a* and erected wall portions 26*b*. The recording heads 18 are secured to the base portion 26*a*. The erected wall portions 26*b* are erected upward from four outer peripheral edges of the base portion 26*a*. The sub carriage 26 has a hollow box shape of which upper surface is opened. A space surrounded by the base portion 26*a* and the four erected wall portions 26*b* functions as an accommodation portion in which at least a part (mainly, sub tanks 37) of the recording heads 18 is accommodated.

A head insertion opening 28 through which the plurality of recording heads 18 can be inserted (that is, which is common to the recording heads 18) is provided in a substantially center portion of the base portion 26*a* of the sub carriage 26. Therefore, the base portion 26*a* is a casing-like frame body formed by four sides. Fixing holes (not illustrated) are provided in a lower surface (surface at the side opposed to the recording medium at the time of recording) of the base portion 26*a* so as to correspond to attachment positions of the recording heads 18.

Figure 10:
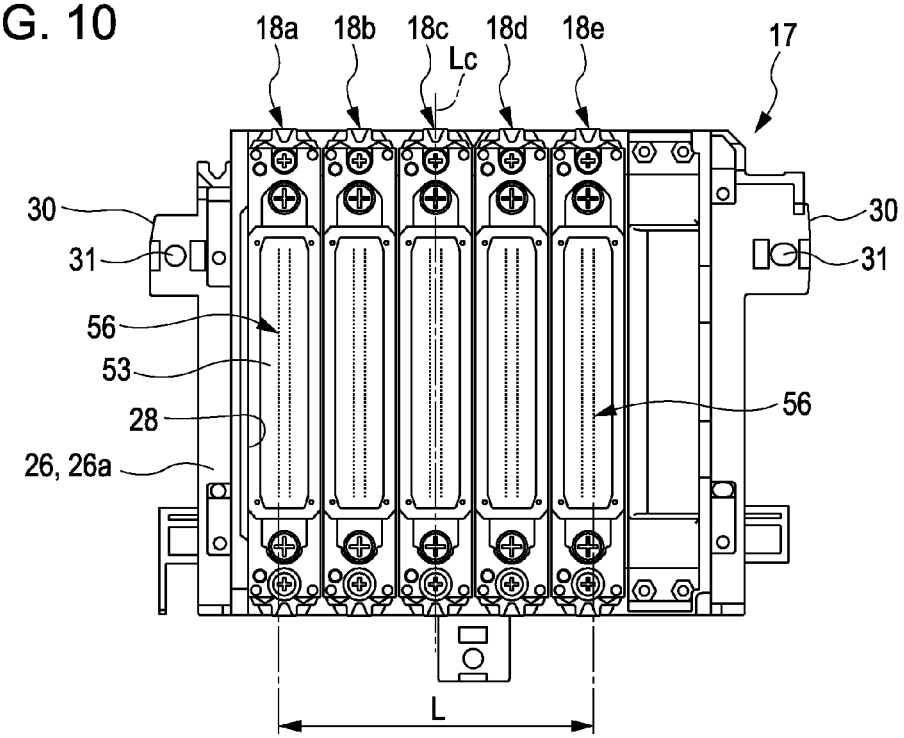
FIG. 10 is a bottom view illustrating the head unit.

In the embodiment, as illustrated in FIG. 10, each of five recording heads 18 in total including a first recording head 18*a*, a second recording head 18*b*, a third recording head 18*c*, a fourth recording head 18*d*, and a fifth recording head 18*e* is secured by screwing. To be more specific, the five recording heads 18 are secured in a state where the sub tanks 37, which will be described later, are inserted from the lower side of the head insertion opening 28 so as to be accommodated in the accommodation portion, and are positioned on the base portion 26*a* so as to be laterally aligned in a direction perpendicular to nozzle rows (main scanning direction in a state of being assembled on the printer 1). Further, these recording heads 18 are secured to the sub carriage 26 such that arrangement of ink colors each of which is assigned to each of the nozzle rows 56 is symmetric in a head arrangement direction (that is, the main scanning direction at the time of the recording operation) with respect to a center (virtual line Lc in FIG. 10) in the head arrangement direction. For example, the arrangement of ink colors is symmetric such that black inks, yellow inks, light blue inks, cyan inks, and magenta inks are arranged in this order from the center in the head arrangement direction to both outer sides in the same direction. If such positional relationship of the recording heads 18 is employed, ink landing order of ink colors onto the recording medium can be made the same on the outbound path and the inbound path. Therefore, the overlapping order of dots of different colors are made the same on the outbound path and the inbound path, thereby suppressing image quality of a recorded image or the like from being deteriorated.

Flange portions 30 are provided on three of the four erected wall portions 26*b* of the sub carriage 26 so as to project laterally. Insertion holes 31 are provided in the flange portions 30 so as to correspond to three attachment threaded holes (not illustrated) which are provided at an attachment position of the head unit 17 onto the bottom plate portion 12*a* of the carriage main body 12. Further, head unit securing screws 22 are fixed to the attachment threaded holes through the insertion holes 31 in a state where the corresponding insertion holes 31 are positioned to the attachment threaded holes in the bottom plate portion 12*a* of the carriage main body 12. With this, the head unit 17 is accommodated in and secured to the carriage main body 12. Further, securing threaded holes 33 for securing the flow path member 24 are provided at four places in total in upper end surfaces of the four erected wall portions 26*b* of the sub carriage 26.

Ink distribution flow paths (not illustrated) for each color are partitioned and formed in the flow path member 24. The ink distribution flow paths correspond to flow path connecting portions 38 of the sub tanks 37 (which will be described later) of the recording heads 18, respectively. As illustrated in FIG. 9, a tube connection portion 34 is provided on an upper surface (surface at the opposite side to the side secured to the sub carriage 26) of the flow path member 24. A plurality of introduction ports 39 each of which corresponds to ink of each color are provided in the tube connection portion 34. Each introduction port 39 communicates with the ink distribution flow path for each corresponding color. Further, if the above ink supply tube 14 is connected to the tube connection portion 34, ink supply paths for each color in the ink supply tube 14 communicate with the corresponding introduction ports 39 in a liquid tight state. With this configuration, inks of each color fed from the ink cartridges through the ink supply tube 14 are introduced to the ink distribution flow paths in the flow path member 24 through the introduction ports 39. Inks which have passed through the ink distribution flow paths flow into the sub tanks 37 of the recording heads 18 through the flow path connecting portions 38. Flow path insertion holes (not illustrated) corresponding to the securing threaded holes 33 of the sub carriage 26 are formed on four corners of the flow path member 24 in a state of penetrating through the flow path member 24 in the plate thickness direction. When the flow path member 24 is secured to the sub carriage 26, flow path fixing screws 45 are fixed (screwed) to the securing threaded holes 33 through the flow path insertion holes.

Figure 11:
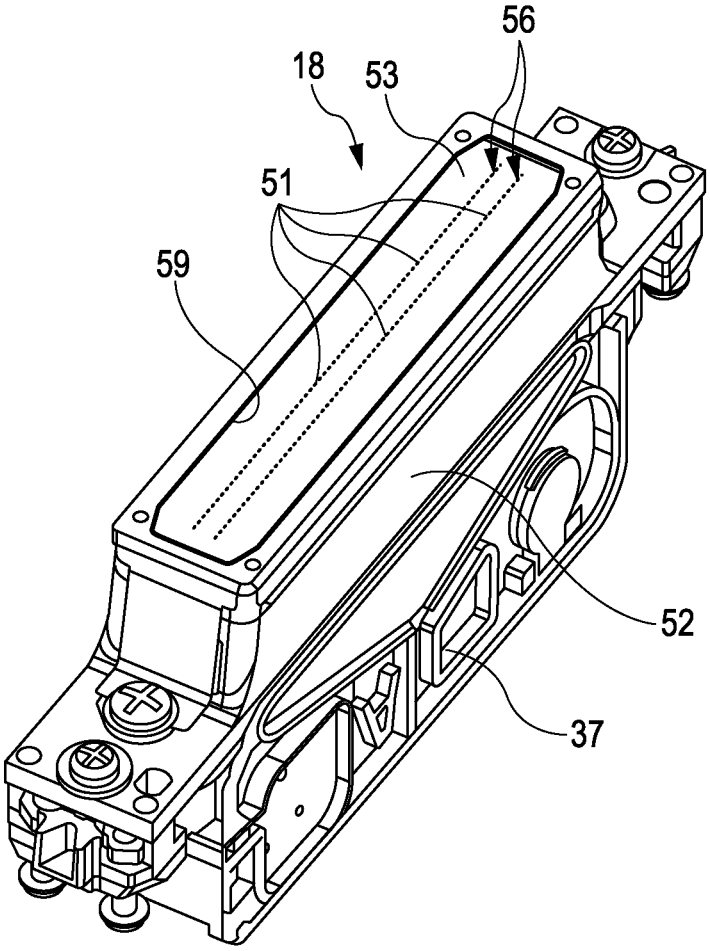
FIG. 11 is a perspective view for explaining a configuration of a recording head.

FIG. 11 is a perspective view for explaining a configuration of the recording heads 18 (one type of a liquid ejecting head) attached to the sub carriage 26. It is to be noted that since a basic configuration and the like are common to the recording heads 18, one of the five recording heads 18 attached to the sub carriage 26 is illustrated as a representative example.

Each recording head 18 includes a flow path unit and a pressure generation unit such as a piezoelectric vibrator or a heat generation element (any of them are not illustrated) in a head case 52. The flow path unit forms an ink flow path including a pressure chamber communicating with nozzles 51. The pressure generation unit generates pressure fluctuation on ink in the pressure chamber. Each recording head 18 is configured to perform a recording operation of ejecting ink through the nozzles 51 and landing the ink onto a recording medium such as recording paper by applying a driving pulse contained in a driving signal COM from a driving signal generation circuit 60, which will be described later, to the pressure generation unit to drive the pressure generation unit. The plurality of nozzles 51 through which ink is ejected are arranged in rows to form nozzle rows 56 (one type of a nozzle group) on the nozzle formation face 53 of each recording head 18. Two nozzle rows 56 are formed in parallel in a direction perpendicular to the nozzle rows. One nozzle row 56 is constituted by 360 nozzle openings provided at a pitch of 360 dpi, for example. The ink flow path, the pressure generation unit, and the like corresponding to each nozzle row 56 are individually provided.

The head case 52 is a hollow box shape member and the flow path unit is secured to a tip end side of the head case 52 in a state where the nozzle formation face 53 is exposed. Further, the pressure generation unit and the like are accommodated in the accommodation portion formed in the head case 52. The sub tank 37 for supplying ink to the flow path unit is attached to a base end surface side (upper surface side) at the opposite side to the tip end surface. The above sub tank 37 is a member which introduces ink from the flow path member 24 to the pressure chamber of the recording head 18. The sub tank 37 has a self-sealing function of opening and closing a valve in accordance with pressure fluctuation therein and controlling the introduction of ink to the pressure chamber. The flow path connecting portions 38 (see, FIG. 8B) which are connected to the ink distribution flow path of the above flow path member 24 are provided on both ends of a rear end surface (upper surface) of the sub tank 37 in the nozzle row direction. Ring-form packings (not illustrated) are fitted into the flow path connecting portions 38 so as to ensure liquid tightness with the connected flow paths. Further, two driving substrates (not illustrated) for supplying a driving signal to the pressure generation unit are provided in the sub tank 37. The above signal cable 15 is electrically connected to the driving substrates. Further, the driving signal transmitted from the driving signal generation circuit 60 of the printer 1 through the signal cable 15 is supplied to the pressure generation unit side through the driving substrates.

Next, an electric configuration of the printer 1 is described.

Figure 12:
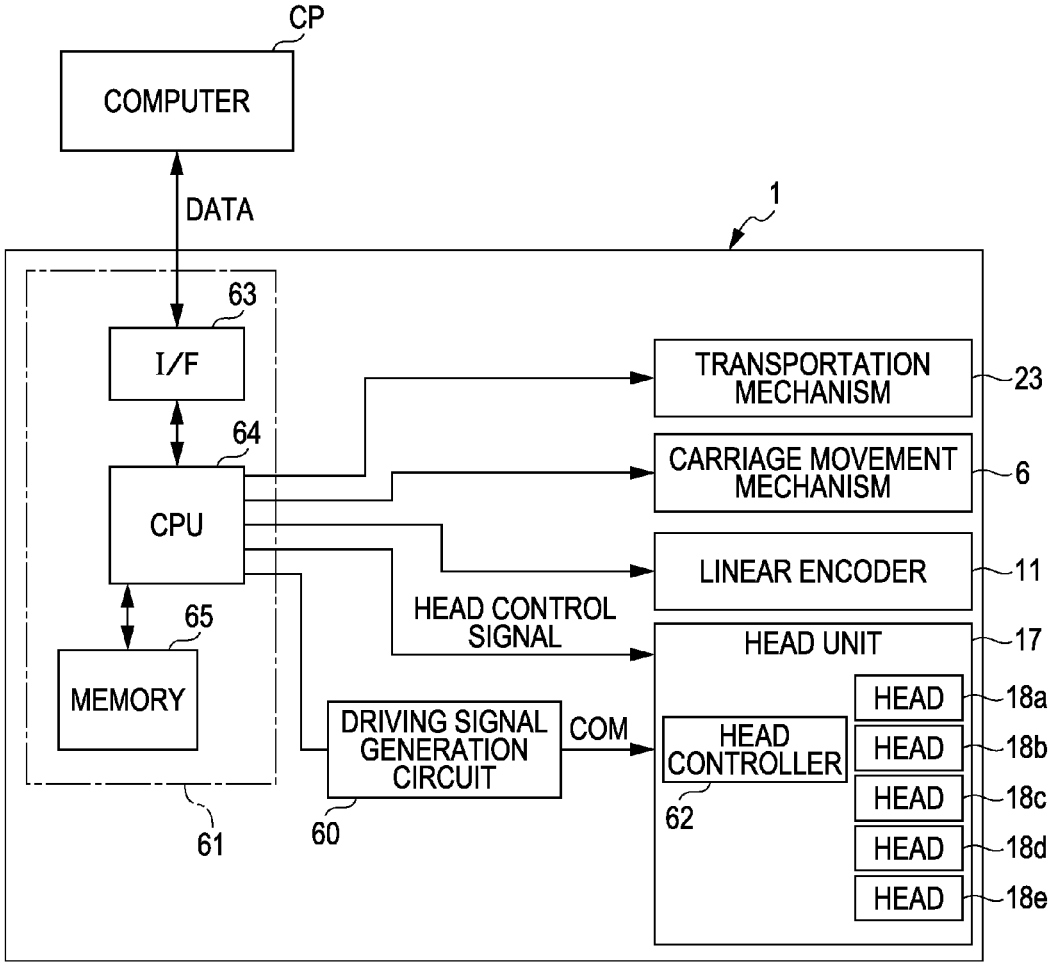
FIG. 12 is a block diagram for explaining an electric configuration of the printer.

FIG. 12 is a block diagram for explaining the electric configuration of the printer 1. A computer CP as an external device is connected to the printer 1 in a communicable manner. The computer CP transmits print data to the printer 1 in accordance with an image to the printer 1 for recording the image onto a recording medium such as recording paper in the printer 1.

The printer 1 according to the embodiment has the transportation mechanism 23, the carriage movement mechanism 6, the driving signal generation circuit 60 (one type of a driving signal generation unit), the head unit 17, and the printer controller 61, which have been described above. The driving signal generation circuit 60 generates an analog voltage signal based on waveform data relating to a waveform of a driving signal transmitted from the printer controller 61. Further, the driving signal generation circuit 60 amplifies the above voltage signal to generate the driving signal COM. The driving signal COM is applied to the pressure generation units of the recording heads 18 at the time of printing processing (recording processing or ejection processing) onto the recording medium. The driving signal COM is a series of signals including at least one ejection driving pulse in a unit period as a repeating cycle. The ejection driving pulse makes the pressure generation units perform a predetermined operation for ejecting ink in liquid droplet form through the nozzles 51 of the recording heads 18.

The printer controller 61 is a control unit for controlling the printer. The printer controller 61 has an interface portion 63, a CPU 64, and a memory 65. The interface portion 63 transmits print data and a printing command, or receives status information of the printer 1 for the computer CP and the like, between the computer CP as an external device and the printer 1. The CPU 64 is an arithmetic processing unit for controlling the entire printer. The memory 65 is a member for ensuring a region in which programs of the CPU 64 are stored, an operation region and the like, and has memory elements such as a RAM and an EEPROM. The CPU 64 controls each unit in accordance with the programs stored in the memory 65.

The printer controller 61 functions as a timing pulse generation unit which generates a timing pulse PTS from an encoder pulse EP output from the linear encoder 11. The timing pulse PTS is a signal which defines a generation initiation timing of the driving signal COM to be generated by the driving signal generation circuit 60. That is to say, the driving signal generation circuit 60 outputs the driving signal COM every time the timing pulse is received. It is to be noted that when the timing pulse PTS is output at an interval corresponding to 720 dpi as dot formation resolution (ink landing interval as a base of design and specification, also referred to as raster resolution) in the main scanning direction, for example, the encoder pulse EP is generated at an interval corresponding to 180 dpi. Therefore, the printer controller 61 generates the timing pulse PTS by multiplying the encoder pulse EP by four times.

The above printer 1 is designed such that the design-based most desirable print result is obtained when a reference value of an environmental temperature at which the printer 1 is used is set to 25° C., for example, and the printer 1 is used at the reference temperature. However, an environmental temperature at which a user uses the printer 1 is not necessarily the reference temperature. For example, when the environmental temperature is higher than the reference temperature, each member constituting the printer 1 is thermally expanded so that error of landing positions of ink ejected through the nozzles 51 of the recording heads 18 on the recording medium possibly occurs. In the same manner, when the environmental temperature is lower than the reference temperature, landing error possibly occurs because each member contracts. Timing control of ink ejection from the recording heads 18 is performed based on the encoder pulse EP output from the linear encoder 11. Therefore, if a deformation amount due to expansion or contraction of the linear scale 10 and a deformation amount due to expansion or contraction of the sub carriage 26 are different from each other, landing error occurs. In particular, as the number of recording heads 18 secured to the sub carriage 26 is larger and the head unit 17 is longer in the main scanning direction, influence by the deviation of the landing positions based on difference of linear expansion coefficients tends to be larger.

In view of the above problem, in the printer 1 according to the invention, it is assumed that an expected maximum temperature change from the reference temperature during usage of the printer 1 is $\Delta t$, a raster resolution in the main scanning direction is P, a longest distance between nozzle rows of the recording heads 18 of the sub carriage 26 is L, a linear expansion coefficient of the sub carriage 26 is $\alpha 1$, a linear expansion coefficient of the linear scale 10 is $\alpha 2$. Under the assumption, in the printer 1, materials of the sub carriage 26 and the linear scale 10 are selected such that $L(|\alpha 1-\alpha 2|)\Delta t \leq P/2$ is satisfied. As illustrated in FIG. 10, the longest distance between nozzle rows L is a distance between the nozzle row 56 (hereinafter, appropriately referred to as one end nozzle row 56) at an outer side (left side) of the first recording head 18*a* in the head arrangement direction and the nozzle row 56 (hereinafter, appropriately referred to as the other end nozzle row 56) at an outer side (right side) of the fifth recording head 18*e* in the head arrangement direction. The first recording head 18*a* is located at one end (left end in FIG. 10) in the head arrangement direction (corresponding to the main scanning direction) among the recording heads 18 secured to the sub carriage 26. The fifth recording head 18*e* is located at the other end (right end in FIG. 10) in the head arrangement direction among the recording heads 18.

That is to say, when a detection position of the scale (slit 10*b*) of the linear scale 10 by the linear encoder 11 is a position corresponding to the center of the head arrangement direction (virtual line Lc in FIG. 10) in the sub carriage 26, the nozzle row 56 which is located at a position farther from the detection position is influenced larger by expansion or contraction due to a temperature change. That is to say, in such case, the one end nozzle row 56 and the other end nozzle row 56 which are located at the farthest positions therefrom are influenced at the largest by expansion or contraction. An absolute value of a difference between a change amount ($\alpha 1 \times L \times \Delta t$) of the interval between the nozzle rows 56 at both ends in the main scanning direction due to expansion or contraction of the sub carriage 26 and a change amount ($\alpha 2 \times L \times \Delta t$) in the main scanning direction due to expansion or contraction of the linear scale 10 when the maximum temperature change $\Delta t$ during normal usage of the printer 1 is generated is made within a range of equal to or lower than half of an ink landing density P in the main scanning direction. With this, even when the environmental temperature at which the printer 1 is used is changed, deviation of relative ink landing positions on the recording medium is suppressed from occurring between the recording heads 18 attached to the sub carriage 26.

Figure 13A:
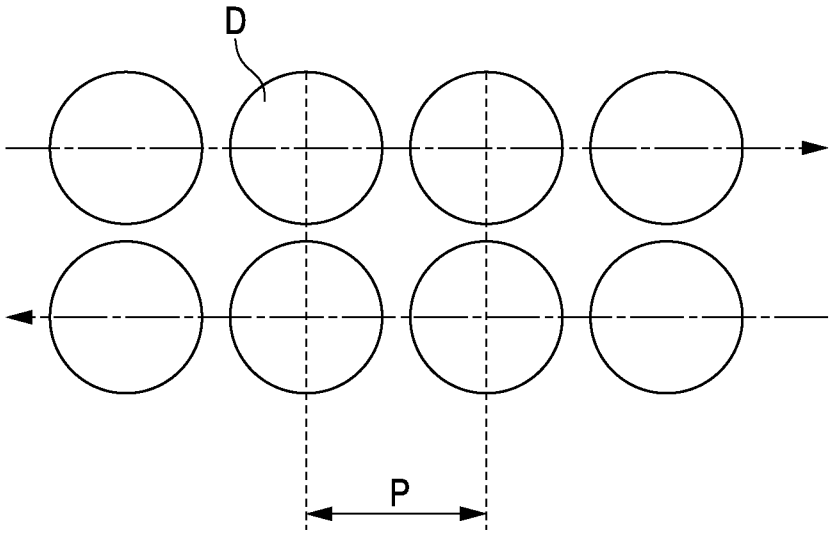
FIGS. 13A and 13B are schematic views for explaining deviation of ink landing positions between a nozzle row at one end and a nozzle row at the other end.
Figure 13B:
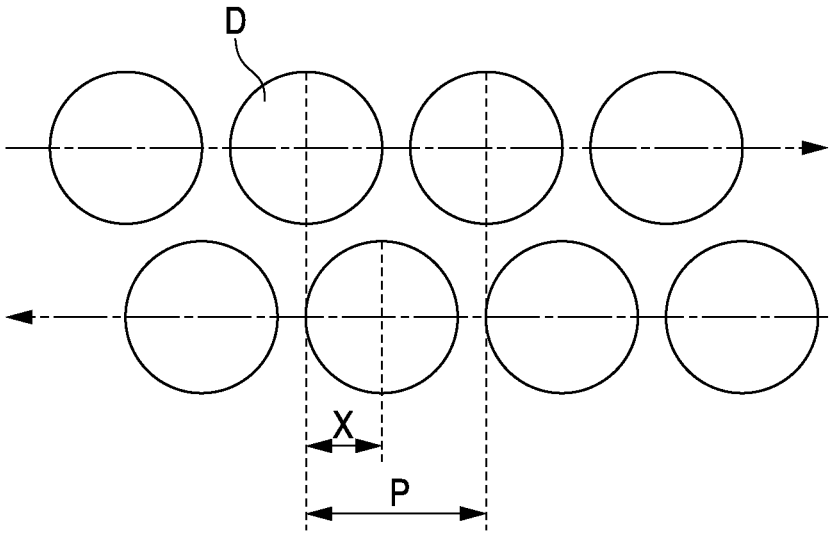

FIGS. 13A and 13B are schematic views for explaining deviation of the ink landing positions between the one end nozzle row 56 and the other end nozzle row 56 which are located at both ends in the head arrangement direction (main scanning direction). It is to be noted that FIG. 13A illustrates arrangement of dots D at the reference temperature. FIG. 13B illustrates arrangement of dots in a state where the environmental temperature is changed from the reference temperature by $\Delta t$. Further, in FIGS. 13A and 13B, a right-left direction corresponds to the main scanning direction of the head unit 17 and a direction from left to right corresponds to the outbound path and a direction from right to left corresponds to the inbound path. In this example, ink is continuously ejected through the nozzles 51 of the one end nozzle row 56 of the first recording head 18*a* at the time of the outbound scanning so as to form a dot group at an upper portion at 720 dpi, that is, at an interval of 35.2 μm. In the same manner, in FIGS. 13A and 13B, ink is continuously ejected through the nozzles 51 of the other end nozzle row 56 of the fifth recording head 18*e* at the time of the inbound scanning so as to form a dot group at a lower portion at 720 dpi.

As illustrated in FIG. 13A, the printer 1 according to the invention is designed such that the landing positions (dot formation positions) of ink in the outbound-and-inbound main scanning direction are aligned at the reference temperature. On the other hand, as illustrated in FIG. 13B, when the environmental temperature is changed from the reference temperature by $\Delta t$, deviation of the landing positions occurs between the nozzle group at the upper portion and the nozzle group at the lower portion in accordance with a difference between a change amount of a distance between the one end nozzle row 56 and the other end nozzle row 56 with the deformation of the sub carriage 26 and a deformation amount of the linear scale 10 in the lengthwise direction, due to the temperature change. However, if a positional deviation amount X (difference between the change amount of the distance between the nozzle rows 56 at both ends and the deformation amount of the linear scale 10) is equal to or lower than half of the raster resolution P, that is, $X \leq 17.6$ μm, influence on granularity (image roughness recognized visually) and color density on a recorded image can be suppressed within an acceptable range. That is to say, deviation of the landing positions can be suppressed to an extent that difference between a state where positional deviation does not occur and a state where positional deviation occurs is not recognized relating to the granularity and the color density sensed by the eyes of a user when the user views the recorded image. Further, when a dither mask (dither matrix) used when a dither processing is performed on print data (pixel data) from the computer CP is designed, if the positional deviation amount X is equal to or lower than half of the raster resolution P, a threshold value and the like of the matrix can be defined such that influence on the granularity and the color difference is suppressed within an acceptable range. It is to be noted that if deviation of the relative landing positions between the one end nozzle row 56 and the other end nozzle row 56 is suppressed within an acceptable range, deviations of landing positions between the nozzle rows 56 on other recording heads 18 are smaller than that.

FIG. 14 is a table illustrating specific examples of combinations of materials of the sub carriage 26 and the linear scale 10 satisfying $L(|\alpha 1-\alpha 2|)\Delta t \leq P/2$. It is to be noted that in this example, the distance L between the one end nozzle row 56 and the other end nozzle row 56 is 65 mm, the expected maximum temperature change $\Delta t$ is 15° C., and the raster resolution P is 720 dpi (35.3 μm). In example 1, a modified polyphenylene ether resin is employed as the material of the sub carriage 26 and polyester is employed as the material of the linear scale 10. The linear expansion coefficient $\alpha 1$ of the sub carriage 26 is $5.0\times10^{-5}$/° C. and the linear expansion coefficient $\alpha 2$ of the linear scale 10 is $6.0\times10^{-5}$/° C. In this example 1, $L(|\alpha 1-\alpha 2|)\Delta t=9.8$ μm is obtained so that a condition of equal to or lower than P/2 (=17.6 μm) is satisfied. In the same manner, in example 2, aluminum alloy is employed as the material of the sub carriage 26 and stainless steel is employed as the material of the linear scale 10. In example 3, stainless steel is employed as any of the materials of the sub carriage 26 and the linear scale 10. Further, in example 4, stainless steel is employed as the material of the sub carriage 26 and glass is employed as the material of the linear scale 10. In any of the examples, $L(|\alpha 1-\alpha 2|)\Delta t \leq P/2$ is satisfied. It is to be noted that the combinations of the materials and specific numerical values of the linear expansion coefficients are not limited to those as illustrated in the embodiment.

In this manner, the materials of the sub carriage 26 and the linear scale 10 are selected so as to satisfy $L(|\alpha 1-\alpha 2|)\Delta t \leq P/2$. With this, even when the environmental temperature at which the printer 1 is used is changed, the deviation of the relative landing positions of ink on the recording medium between different recording heads 18 attached to the sub carriage 26 can be suppressed within an acceptable range and influence on the image quality of an image recorded on the recording medium can be suppressed. In particular, landing positions between inks of the same color can be prevented from being deviated in a configuration in which a plurality of pairs of the recording heads 18 having the nozzle rows 56 of the same color are provided like the embodiment. Further, the materials of the sub carriage 26 and the linear scale 10 are not necessarily needed to be the same and the freedom of selection of the materials can be ensured.

It is to be noted that the invention is not limited to the above embodiment and various variations can be made based on description in the aspect of the invention.

For example, the configuration and the number of recording heads 18 attached to the sub carriage 26 as the head securing member are not limited to those described in the above embodiment.

In addition, as described above, various types of well-known systems can be employed as the linear encoder 11 and the configuration and a pattern of the scales (slits 10*b*) of the linear scale 10 are not limited to those described in the above embodiment.

Further, in the above description, the ink jet printer 1 is described as one type of a liquid ejecting apparatus. However, the invention can be also applied to other liquid ejecting apparatuses having a configuration in which a plurality of liquid ejecting heads are secured to a head securing member to form a liquid ejecting head unit and a position of the liquid ejecting head unit in the scanning direction is detected by a linear encoder. For example, the invention can be applied to a display manufacturing apparatus for manufacturing color filters of a liquid crystal display and the like, an electrode manufacturing apparatus for forming electrodes of an organic electro luminescence (EL) display, a field emission display (FED) and the like, a chip manufacturing apparatus for manufacturing a biochip (biochemical element), and a micro pipette for supplying a trace amount of sample solution accurately.

What is claimed is:

1. A liquid ejecting apparatus comprising:

a liquid ejecting head unit which has a plurality of liquid ejecting heads having nozzles through which liquid is ejected, and a head securing member to which the plurality of liquid ejecting heads are secured in parallel in a first direction;

a head unit movement mechanism which moves the liquid ejecting head unit in the first direction; and a linear encoder which has a linear scale arranged along the first direction and a detector for reading a scale formed on the linear scale, the liquid ejecting apparatus controlling liquid ejection of each liquid ejecting head based on a detection signal from the linear encoder, wherein when it is assumed that an expected maximum temperature change from a reference temperature during usage of the liquid ejecting apparatus is $\Delta t$, a liquid landing interval corresponding to dot formation resolution on a landing target in the first direction is P, a maximum distance between nozzle rows of the liquid ejecting heads on the head securing member is L, a linear expansion coefficient of the head securing member is al, and a linear expansion coefficient of the linear scale is $\alpha 2$, $L(|\alpha 1-\alpha 2|)\Delta t \leq P/2$ is satisfied.

2. The liquid ejecting apparatus of claim 1, wherein L, $\Delta t$, and P are constraints of the apparatus, and wherein materials of the head securing member and linear scale are selected such that $\alpha 1$ and $\alpha 2$ satisfy $L(|\alpha 1-\alpha 2|)\Delta \leq P/2$.

3. The liquid ejecting apparatus of claim 2, wherein $L \approx 65$ mm.

4. The liquid ejecting apparatus of claim 2, wherein $\Delta t \approx 15°$ C.

5. The liquid ejecting apparatus of claim 2, wherein $P \approx 35.2$ μm.

6. The liquid ejecting apparatus of claim 2, wherein:

$L \approx 65$ mm;

$\Delta t..15°$ C.; and $P \approx 35.2$ μm;

and wherein materials of the head securing member and linear scale are selected such that $\alpha 1$ and $\alpha 2$ satisfy $$|\alpha 1-\alpha 2| \leq \frac{p}{2 \cdot L \cdot \Delta t}$$

$$|\alpha 1-\alpha 2| <\approx \frac{35.2\ \mu m}{2 \cdot (65\ mm) \cdot (15°\ C.)}$$

$$|\alpha 1-\alpha 2| <\approx \frac{0.0352\ mm}{1950\ mm\ °\ C.}$$

$$|\alpha 1-\alpha 2| <\approx \frac{1.8 \cdot 10^{-5}}{°\ C.}.$$

7. The liquid ejecting apparatus of claim 2, wherein materials of the head securing member and linear scale are selected such that $\alpha 1$ and $\alpha 2$ satisfy $$|\alpha 1-\alpha 2| <\approx \frac{1.8 \cdot 10^{-5}}{°\ C.}.$$

8. The liquid ejecting apparatus of claim 1, wherein $$(1.0 \cdot 10^{-5})/°\ C. <\approx \alpha 1 <\approx (5.0 \cdot 10^{-5})/°\ C.$$

9. The liquid ejecting apparatus of claim 1, wherein $$(8.0 \cdot 10^{-6})/°\ C. <\approx \alpha 2 <\approx (6.0 \cdot 10^{-5})/°\ C.$$

10. The liquid ejecting apparatus of claim 1, wherein:

$$(1.0 \cdot 10^{-5})/°\ C. <\approx \alpha 1 <\approx (5.0 \cdot 10^{-5})/°\ C.;\ \text{and}$$

$$(8.0 \cdot 10^{-6})/°\ C. <\approx \alpha 2 <\approx (6.0 \cdot 10^{-5})/°\ C.$$

11. The liquid ejecting apparatus of claim 10, wherein $$|\alpha 1-\alpha 2| <\approx \frac{1.8 \cdot 10^{-5}}{°\ C.}.$$

12. The liquid ejecting apparatus of claim 1, wherein the head securing member comprises at least one member of the group consisting of polyphenylene ether (PPE) resin, aluminum alloy ADC12, stainless steel SUS304, and stainless steel SUS430.

13. The liquid ejecting apparatus of claim 1, wherein the linear scale comprises at least one member of the group consisting of polyester, stainless steel SUS304, and glass.

14. The liquid ejecting apparatus of claim 1, wherein the head securing member comprises at least one member of the first group consisting of polyphenylene ether (PPE) resin, aluminum alloy ADC12, stainless steel SUS304, and stainless steel SUS430; and wherein the linear scale comprises at least one member of the second group consisting of polyester, stainless steel SUS304, and glass.

15. The liquid ejecting apparatus of claim 1, wherein the head securing member and the linear scale comprise different materials than one another.

16. The liquid ejecting apparatus of claim 1, wherein the head securing member and the linear scale comprise the same material as one another.

17. The liquid ejecting apparatus of claim 1, wherein the head securing member comprises polyphenylene ether (PPE) resin; and wherein the linear scale comprises polyester.

18. The liquid ejecting apparatus of claim 1, wherein the head securing member comprises aluminum alloy ADC12; and wherein the linear scale comprises stainless steel SUS304.

19. The liquid ejecting apparatus of claim 1, wherein the head securing member and the linear scale both comprise stainless steel SUS304.

20. The liquid ejecting apparatus of claim 1, wherein the head securing member comprises stainless steel SUS430; and wherein the linear scale comprises glass.

* * * * *